US007344621B2

(12) United States Patent
Nakamura et al.

(10) Patent No.: US 7,344,621 B2
(45) Date of Patent: Mar. 18, 2008

(54) PAPER ADDITIVE COMPOSITION AND METHOD FOR PRODUCING PAPER USING THE SAME

(75) Inventors: Yasuyuki Nakamura, Itami (JP); Tetsuya Tamai, Nishinomiya (JP); Kazumichi Asakura, Nishinomiya (JP)

(73) Assignee: NOF Corporation, Tokyo (JP)

( * ) Notice: Subject to any disclaimer, the term of this patent is extended or adjusted under 35 U.S.C. 154(b) by 0 days.

(21) Appl. No.: 10/807,092

(22) Filed: Mar. 23, 2004

(65) Prior Publication Data

US 2004/0188047 A1 Sep. 30, 2004

(30) Foreign Application Priority Data

Mar. 24, 2003 (JP) ..... 2003-080113
Mar. 24, 2003 (JP) ..... 2003-080114
Dec. 19, 2003 (JP) ..... 2003-423434

(51) Int. Cl.
*D21H 17/33* (2006.01)
*D21H 17/45* (2006.01)

(52) U.S. Cl. ..... 162/164.6; 162/158; 162/164.1; 162/168.3; 162/183; 8/188; 8/194; 554/35; 554/51

(58) Field of Classification Search ..... 162/158, 162/164.1, 164.6, 168.3, 183; 8/188, 194; 554/35, 51
See application file for complete search history.

(56) References Cited

U.S. PATENT DOCUMENTS

| | | | | |
|---|---|---|---|---|
| 2,772,969 | A | 12/1956 | Reynolds, Jr. et al. | |
| 2,926,116 | A | 2/1960 | Keim et al. | |
| 2,971,931 | A * | 2/1961 | Glade | 442/84 |
| 3,840,486 | A | 10/1974 | Dumas | |
| 4,154,618 | A * | 5/1979 | Burke | 106/31.67 |
| 4,264,516 | A | 4/1981 | Hiestand | |
| 4,323,490 | A | 4/1982 | Töpfl | |
| 4,720,383 | A * | 1/1988 | Drach et al. | 424/70.21 |
| 5,314,721 | A * | 5/1994 | Muller et al. | 427/386 |
| 5,354,425 | A | 10/1994 | Mackey et al. | |
| 5,474,856 | A * | 12/1995 | Tamagawa et al. | 428/537.5 |
| 5,686,376 | A * | 11/1997 | Rusche et al. | 502/329 |
| 5,744,001 | A | 4/1998 | Linhart et al. | |
| 6,033,523 | A * | 3/2000 | Dwiggins et al. | 162/111 |
| 6,162,329 | A * | 12/2000 | Vinson et al. | 162/158 |
| 6,346,169 | B1 | 2/2002 | Ikeda et al. | |

FOREIGN PATENT DOCUMENTS

| | | | |
|---|---|---|---|
| EP | 0 480 600 | A1 | 9/1991 |
| GB | 1 300 505 | A1 | 12/1972 |
| JP | 51-38600 | A | 3/1976 |
| JP | 53-147803 | A | 12/1978 |
| JP | 60-139897 | A | 7/1985 |
| JP | 63-165597 | A | 7/1988 |
| JP | 03-124895 | A | 5/1991 |
| JP | 03-269199 | A | 11/1991 |
| JP | 04-100995 | A | 4/1992 |
| JP | 04-185791 | A | 7/1992 |
| JP | 04-185792 | A | 7/1992 |
| JP | 5-156596 | A | 6/1993 |
| JP | 05-230798 | A | 9/1993 |
| JP | 9-506683 | A | 6/1997 |
| JP | 11-200282 | A | 7/1999 |
| JP | 11-200283 | A | 7/1999 |
| JP | 11-200284 | A | 7/1999 |
| JP | 11-269799 | A | 10/1999 |
| JP | 2002-275786 | A | 9/2002 |
| WO | WO 98/39376 | A1 | 9/1998 |
| WO | WO 01/59213 | A1 | 8/2001 |

OTHER PUBLICATIONS

JP 2002-275786 A, full translation.*

* cited by examiner

*Primary Examiner*—Steven P. Griffin
*Assistant Examiner*—Dennis R. Cordray
(74) *Attorney, Agent, or Firm*—The Webb Law Firm, P.C.

(57) ABSTRACT

A paper additive composition comprising an amide compound (a) obtained by reacting a polyamine and a carboxylic acid or a salt of the amide compound (a) is provided. The polyamine is shown by formula (1):

$$R—(NH—R^1)n\text{-}NH_2 \quad (1)$$

(wherein R is $H_2N—R^1$ or $R^2$, and each $R^1$ is independently an alkylene group having 1 to 4 carbon atoms, $R^2$ is an alkyl group or alkenyl group having 12 to 22 carbon atoms, and n is an integer of 1 to 3); the number of carbon atoms of the carboxylic acid is 10 to 24; the amide compound is obtained by reacting the carboxylic acid at a ratio of 0.5 to 4.3 moles per 1 mol of the polyamine; and the ratio of a tertiary amine value to a total amine value of the amide compound (a) is 0.60 to 0.99.

16 Claims, No Drawings

PAPER ADDITIVE COMPOSITION AND METHOD FOR PRODUCING PAPER USING THE SAME

This application claims priority to Application Nos. JP 2003-80113, filed Mar. 24, 2003, JP 2003-80114, filed Mar. 24, 2003, and JP 2003-423434, filed Dec. 19, 2003.

BACKGROUND OF THE INVENTION

1. Field of the Invention

The present invention relates to a paper additive composition that can provide bulky and soft paper having a sufficient strength and a method for producing paper using the same.

2. Description of the Related Art

In recent years, in view of shortage of pulp resources and a consequent increase in the price of pulp, effective utilization of the resources and environment protection, it has been attempted to reuse waste paper pulp, reduce the amount of pulp used for paper production, and reduce the basis weight of various paper products. In addition, in order to reduce the production cost of paper product or increase the production amount, and further to prevent accidents such as the toppling over of vehicles or the falling of the load due to overloading when paper products are being transported, it is very important to reduce the basis weight of paper to make it light. However, for thin paper whose basis weight is reduced or paper containing a large amount of waste paper pulp, the bulkiness is insufficient, and printed ink penetrates the paper to the back face. For these reasons, there is a demand for a method for producing bulky paper even when the amount of pulp is small or when a large amount of waste paper pulp is contained.

The following methods are disclosed as methods that provide bulky paper: a method that employs an additive comprising a polyoxyalkylene adduct of a fatty acid or a polyoxyalkylene adduct of a fatty acid ester in Japanese Laid-Open Patent Publication (Tokkai) No. 11-200284; a method that employs an additive containing oils or fats or a nonionic surfactant derived form sugar alcohol in Japanese Laid-Open Patent Publication (Tokkai) No. 11-200283; and a method that employs a cationic compound, amine or its salt, an amphoteric compound, a nonionic surfactant or the like as an additive in Japanese Laid-Open Patent Publication (Tokkai) No. 11-269799. However, these methods failed to provide a sufficient bulkiness effect, and the strength of the resultant paper is also insufficient. In order to increase the strength of paper, a method of adding a polymer compound such as starch, polyacrylamide, or polyamidepolyamine-epichlorohydrin resin is known. However, when the above-described additives for providing bulky paper and the polymer compound are used together in a paper formation system, the bulkiness effect of the additive is reduced.

Japanese Laid-Open Patent Publication (Tokkai) No. 2002-275786 discloses a method of using an additive comprising a fatty acid polyamidepolyamine. The paper obtained by this method has improved bulkiness, but foaming occurs in a higher degree during paper formation.

Furthermore, in all of the methods described above, paper dust tends to occur in the paper formation process or in the obtained paper.

In recent years, there is a demand for soft paper desired for comic books or paperbacks, and it is also desired to improve softness and touch for handy sanitary paper (e.g., bathroom tissue and facial tissue). Examples of softening agents to improve the softness of paper include glycerin, polyethylene glycol, urea, paraffin emulsifier, and a quaternary ammonium salt. For example, Japanese Laid-Open Patent Publication (Tokkai) No.5-156596 discloses a moisture absorbent for paper containing salts, polyhydric alcohols, or saccharides having hygroscopicity; Japanese Laid-Open Patent Publication (Tokkai) No.60-139897 discloses a softening agent for paper that is a fatty acid ester additive comprising oleic acid polyethylene glycol ester and dioleoyl phthalate; and Jaspanese Laid-Open Patent Publication (Tokuhyo) No.9-506683 discloses a softening agent for paper employing a polyhydroxyfatty acid amide compound. However, with these additives, a sufficient effect of improving the softness cannot be obtained and the foaming in the paper formation process is not suppressed.

When paper is produced by the use of pulp containing a large amount of waste paper pulp, much loading material such as fine fibers or calcium carbonate is contained in a pulp slurry of the system, so that the drainage of the pulp slurry is reduced. A method of adding a polymer compound such as polyacrylamide, polyethyleneimine in order to improve the drainage is known. However, when any of the above-described additives for providing bulky paper and such a polymer compound are used together in a paper formation system, the bulkiness effect of the additive is reduced. In the paper formation process, it is also desired to incorporate a large amount of fine fibers and loading material that are contained in the slurry into the paper (i.e., high retention is desired).

As described above, an additive for paper that can provide bulky and soft paper having a sufficient strength, that hardly causes foaming in the paper formation process, that provides a high retention and good drainage, and that causes no reduction in operability due to occurrence of paper dust has not been obtained yet.

SUMMARY OF THE INVENTION

As a result of in-depth research to solve the conventional problems as described above, the inventors of the present invention found that when a paper additive composition containing an amide compound obtained by reacting a specific carboxylic acid and a specific polyamine, in which an amine value is controlled is used, paper that is more bulky and soft than conventional paper can be obtained, and the foaming during paper formation can be suppressed to a low level, and thus achieved the present invention.

The paper additive composition of the present invention comprises an amide compound (a) obtained by reacting a polyamine and a carboxylic acid or a salt of the amide compound (a); wherein the polyamine is shown by formula (1):

$$R—(NH—R^1)n\text{-}NH_2 \quad (1)$$

(wherein R is $H_2N—R^1$ or $R^2$, and each $R^1$ is independently an alkylene group having 1 to 4 carbon atoms, $R^2$ is an alkyl group or alkenyl group having 12 to 22 carbon atoms, and n is an integer of 1 to 3); the number of carbon atoms of the carboxylic acid is 10 to 24; the amide compound is obtained by reacting the carboxylic acid at a ratio of 0.5 to 4.3 moles per 1 mol of the polyamine; and the ratio of a tertiary amine value to a total amine value of the amide compound (a) is 0.60 to 0.99.

In a preferred embodiment, the composition further comprises an ammonium compound (b), wherein the ammonium compound (b) is at least one selected form the group consisting of a quaternary ammonium salt shown by formula (2):

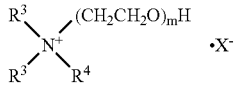

(2)

(wherein each $R^3$ is independently a hydrocarbon group having 10 to 24 carbon atoms, $R^4$ is an alkyl group having 1 to 3 carbon atoms or a benzyl group, m is 1 to 10 and $X^-$ is an anion), and a quaternary ammonium salt shown by formula (3):

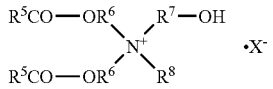

(3)

(wherein each $R^5CO$ is independently an acyl group having 10 to 24 carbon atoms, each $R^6$ is independently an alkylene group having 2 to 4 carbon atoms, $R^7$ is an alkylene group having 2 to 4 carbon atoms, $R^8$ is an alkyl group having 1 to 3 carbon atoms or a benzyl group, and $X^-$ is an anion).

In a preferred embodiment, the composition further comprises a polyacrylamide compound (c).

In a preferred embodiment, the carboxylic acid has at least one of an unsaturated bond and a branched chain, or the carboxylic acid is a mixture of carboxylic acids that comprise a carboxylic acid having at least one of an unsaturated bond and a branched chain at a ratio of at least 40 wt %.

The method for producing paper of the present invention comprises the step of, adding the above-mentioned paper additive composition at a ratio of 0.03 to 8 parts by weight with respect to 100 parts by weight of pulp in production of paper.

In a preferred embodiment, the addition step comprises an addition of the paper additive composition to a mixture comprising pulp and water in a paper formation process.

In a preferred embodiment, the addition step comprises an application of the paper additive composition onto a surface of a pulp sheet obtained in a paper formation process.

Thus, the invention described herein makes possible the objectives of: providing a paper additive composition with which bulky and soft paper can be obtained and the foaming during paper formation can be suppressed to a low level; providing a paper additive composition having the above properties with which paper having a sufficient strength can be produced and the drainage and the retention are good in the paper formation process; providing a paper additive composition having the above properties with which paper dust hardly occurs in the paper formation process or in the obtained paper; and providing a method for efficiently producing paper having the excellent properties as described above, using the above-described composition.

DETAILED DESCRIPTION OF THE INVENTION

Hereinafter, the materials employed in the present invention, the paper additive composition containing the same, and the method for producing paper using the same will be described in order.

(I) Amide Compound

The amide compound that is the main component of the paper additive composition of the present invention is an amide compound obtained by reacting a polyamine and a carboxylic acid or a salt of the amide compound (a). In this specification, such an amide compound or its salt may be referred to as "amide compound (a)" or simply "compound (a)".

The polyamine is shown by the following formula(1):

$$R—(NH—R^1)n\text{-}NH_2 \quad (1)$$

wherein R is $H_2N—R^1$ or $R^2$, and each $R^1$ is independently an alkylene group having 1 to 4 carbon atoms, $R^2$ is an alkyl group or alkenyl group having 12 to 22 carbon atoms, and n is an integer of 1 to 3.

In other words, this polyamine is an amine compound having at least two or three amino groups in the molecule, and shown by the following formula (1.1):

$$H_2N—R^1—(NH—R^1)n\text{-}NH_2 \quad (1.1)$$

or formula(1.2):

$$R^2—(NH—R^1)n\text{-}NH_2 \quad (1.2)$$

wherein $R^1$, $R^2$, and n are as defined in formula(1).

Specific examples of $R^1$ in formula(1) include a methylene group, an ethylene group, a trimethylene group, a tetramethylene group, and a butylene group. Different $R^1$ may be present in one molecule, and two or more polyamines may be used. A preferable $R^1$ is an ethylene group. When the number of carbon atoms of the alkylene group exceeds 4, the handling of the resultant amide compound becomes difficult.

$R^2$ is an alkyl group or alkenyl group having 12 to 22 carbon atoms as described above and may be linear or have a branched chain. Specific examples of $R^2$ include a dodecyl group, a tridecyl group, an isotridecyl group, a tetradecyl group, a tetradecenyl group, a pentadecyl group, a hexadecyl group, an isohexadecyl group, a hexadecenyl group, a heptadecyl group, an octadecyl group, an octadecenyl group, a nonadecyl group, an icosyl group, a henicosyl group, and a docosyl group. Preferably, $R^2$ is an alkyl group or alkenyl group having a branched chain and having 16 to 22 carbon atoms. When the number of carbon atoms is less than 12, a sufficient bulkiness effect cannot be obtained, and when the number of carbon atoms is more than 22, the handling of the obtained amide compound becomes difficult.

When the amide compound obtained from the compound shown by formula(1) is used, bulky and soft paper can be prepared.

As the carboxylic acid used to prepare the amide compound (a), a carboxylic acid having 10 to 24 carbon atoms is used. This carboxylic acid may be either a saturated carboxylic acid or an unsaturated carboxylic acid, and may be either a linear carboxylic acid or a carboxylic acid having a branched chain. It is preferable that at least 40 wt % of the carboxylic acid have at least one of an unsaturated bond and a branched chain. When a composition comprising the amide compound obtained using such a carboxylic acid is used, bulky and soft paper can be prepared.

Examples of the carboxylic acid having 10 to 24 carbon atoms include capric acid, lauric acid, myristic acid, palmitic acid, palmitoleic acid, isopalmitic acid, stearic acid, oleic acid, linoleic acid, linolenic acid, isostearic acid, arachic acid, behenic acid, erucic acid, and lignoceric acid; and mixed fatty acids derived from natural oils or fats such as cocoanut oil fatty acid, palm oil fatty acid, beef tallow fatty acid, lard fatty acid, soybean oil fatty acid, rape seed oil fatty acid, tall oil fatty acid, olive oil fatty acid, cocoa butter fatty acid, sesame oil fatty acid, corn oil fatty acid, sunflower oil fatty acid, cotton seed oil fatty acid, and hydrogenated substances thereof. These fatty acids can be used alone or in combination of two or more. Among these, a carboxylic acid having 12 to 22 carbon atoms is preferable, a carboxylic acid having 16 to 22 carbon atoms is more preferable, and a carboxylic acid having 14 to 18 carbon atoms is particularly preferable. With a carboxylic acid having less than 10 carbon atoms, the resultant amide compound can provide only a low effect of improving the bulkiness and the softness, and with a carboxylic acid having more than 24 carbon atoms, the handling of the resultant amide compound becomes difficult.

Examples of carboxylic acids having an unsaturated bond include oleic acid, linoleic acid, linolenic acid, erucic acid and palmitoleic acid. Examples of carboxylic acids having a branched chain include isopalmitic acid and isostearic acid. These fatty acids may contain other fatty acids as impurities, and such fatty acids containing impurities can be utilized as well. Examples of natural mixed fatty acids having 40 to 100 wt % of an unsaturated carboxylic acid include soybean oil fatty acid, palm oil fatty acid, olive oil fatty acid, cocoa butter fatty acid, sesame oil fatty acid, corn oil fatty acid, sunflower oil fatty acid, cotton seed oil fatty acid, beef tallow fatty acid, and lard fatty acid. Particularly preferable examples of carboxylic acids having at least one of unsaturated bonds and branched chains or a mixture of these carboxylic acids include soybean oil fatty acid, oleic acid, and erucic acid.

The amide compound contained in the paper additive composition of the present invention can be obtained by reacting the polyamine shown by formula(1) with the above-described carboxylic acid. In this reaction, the carboxylic acid is used at a ratio of 0.5 to 4.3 moles per 1 mol of the polyamine. When the amount of the carboxylic acid is less than 0.5 moles, a composition containing the resultant amide compound cannot provide sufficiently bulky and soft paper. When the amount is more than 4.3 moles, the handling of the resultant amide compound becomes difficult.

When the polyamine is a compound shown by formula (1.1):

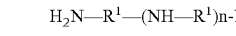

$$H_2N—R^1—(NH—R^1)n\text{-}NH_2 \quad (1.1)$$

(wherein $R^1$ and n are the same as defined above), it is preferable to react the carboxylic acid at a ratio of 1.5 to 4.3 moles per 1 mol of the polyamine to obtain sufficient bulkiness. The number of moles of the carboxylic acid used for reaction depends on the number n, and preferably is 1.5 to (n+1.3) moles, more preferably 1.7 to (n+1.3) moles, and particularly preferably 1.9 to (n+1.1) moles.

When the polyamine is a compound shown by formula (1.2):

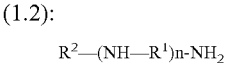

$$R^2—(NH—R^1)n\text{-}NH_2 \quad (1.2)$$

(wherein $R^1$, $R^2$ and n are the same as defined above), it is preferable to react the carboxylic acid at a ratio of 0.5 to 3.3 moles per 1 mol of the polyamine for better handling of the resultant amide compound (a). The number of moles of the carboxylic acid used for reaction depends on the number n, and preferably is 0.5 to (n+0.3) moles, more preferably 0.7 to (n+0.3) moles, and particularly preferably 0.9 to (n+0.1) moles.

When the polyamine shown by formula(1) is reacted with the carboxylic acid, an amidation reaction in which the carboxylic acid is reacted with amino groups predominantly proceeds until the acid value of the reaction mixture reaches about 10% of the theoretical acid value of the initial mixture of the raw materials, and a compound in which the ratio of the tertiary amine value to the total amine value is 0 to 0.4 is produced. However, when the acid value becomes less than 10% of the theoretical acid value of the initial mixture of the raw materials, a reduction of the acid value relative to the reaction time becomes small, so that the regular amidation reaction should be stopped at this stage. From this stage, a reaction proceeds under predetermined conditions so that a dehydration and condensation reaction between the amide groups and amino groups in the formed amide compound occurs, resulting in an amide compound having tertiary amine moieties. According to the reaction, the ratio of the tertiary amine value to the total amine value of the resultant amide compound exceeds 0.4. In the present invention, an amide compound. (i.e., an amide compound having tertiary amine moieties) in which the ratio of the tertiary amine value to the total amine value is 0.60 to 0.99 is employed. Such a compound can be obtained by, for example, allowing the reaction to proceed until the acid value is reduced to 75% or less of the acid value at the stage in which the acid value reached 10% or less of the theoretical acid value of the initial reaction mixture. There is no limitation regarding the method for proceeding such a reaction (i.e., a dehydration and condensation reaction between the amide groups and amino groups in the amide compound). For example, a method of performing the reaction under reduced pressure after an amide compound is produced, or a method of performing the reaction at a higher temperature can be employed. The ratio of the tertiary amine value to the total amine value of the resultant amide compound is 0.60 to 0.99, as described above, and preferably 0.70 to 0.99. When this value is less than 0.60, the foaming of pulp slurry in the process of producing paper becomes high and the handling of the polyamide comopound becomes difficult.

Although the amide compound itself can be used as an additive for paper, the handling becomes even easier if the amide compound is used in the form of an acid salt by being neutralized with an inorganic acid or an organic acid or in the form of a quaternary ammonium salt obtained by being reacted with a quaternizing agent.

Examples of the inorganic acid include hydrochloric acid, sulfuric acid, carbonic acid, nitric acid and phosphoric acid. Examples of the organic acid include formic acid, acetic acid, propionic acid, octylic acid, butyric acid, oxalic acid, malonic acid, itaconic acid, adipic acid, succinic acid, sebacic acid, citric acid, hydroxybenzoic acid, malic acid, hydroxymalonic acid, lactic acid, salicylic acid, hydroxyvaleric acid, aspartic acid, glutamic acid, taurin, sulfamic acid, lauric acid, myristic acid, palmitic acid, stearic acid, and oleic acid. Among these, organic acids are preferable, and among these, formic acid, acetic acid and lactic acid are particularly preferable. For the amount of the acid used to form a salt, the total amine value of a product obtained by the above-described reaction is measured, and a necessary amount is determined, depending on the purpose. It is preferable that an inorganic acid or an organic acid is added in an equivalent of the total amine value to form a salt of the amide compound.

Examples of the quaternizing agent include dimethyl sulfate, diethyl sulfate, and methyl chloride. The quaternizing agent is used at a ratio of 0.8 to 2.3 equivalent of the total amine value.

The thus obtained amide compound (a) or its salt can be handled easily, and can provide bulky and soft paper. Furthermore, it is advantageous to add this compound in a pulp slurry in which pulp fibers are dispersed in water in an arbitrary ratio, which hardly causes foaming.

(II) Ammonium Compound

The paper additive composition of the present invention comprises an ammonium compound, if necessary, in addition to the amide compound. This ammonium compound is at least one of the quaternary ammonium salts shown by formula (2) and the quaternary ammonium salts shown by formula (3). In this specification, this ammonium compound may be referred to as "ammonium compound (b)" or simply "compound (b)". When this ammonium compound is contained, even more soft paper can be produced, and paper dust in the paper formation process or of the resultant paper can be suppressed from occurring effectively.

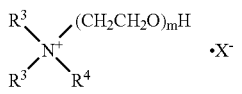

(2)

wherein each $R^3$ is independently a hydrocarbon group having 10 to 24 carbon atoms, $R^4$ is an alkyl group having 1 to 3 carbon atoms or a benzyl group, m is 1 to 10 and $X^-$ is an anion.

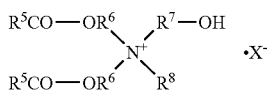

(3)

wherein each $R^5CO$ is independently an acyl group having 10 to 24 carbon atoms, each $R^6$ is independently an alkylene group having 2 to 4 carbon atoms, $R^7$ is an alkylene group having 2 to 4 carbon atoms, $R^8$ is an alkyl group having 1 to 3 carbon atoms or a benzyl group, and $X^-$ is an anion.

In the quaternary ammonium salt shown by formula(2) of the ammonium compound (b), specific examples of $R^3$ include the following groups: an alkyl group such as a decyl group, an undecyl group, a dodecyl group, a tridecyl group, an isotridecyl group, a tetradecyl group, a pentadecyl group, a hexadecyl group, an isohexadecyl group, a heptadecyl group, an octadecyl group, a nonadecyl group, an icosyl group, a henicosyl group, and a docosyl group; and an alkenyl group such as tetradecenyl group, a hexadecenyl group, an octadecenyl group, and a docosenyl group. The number of carbon atoms of $R^3$ is preferably 12 to 22, and it is more preferably that at least 40 wt % of $R^3$ that is present have an unsaturated bond or a branched chain. When an additive composition containing a quaternary ammonium salt with $R^3$ having less than 10 carbon atoms is used, the effect of improving the softness and the effect of suppressing paper dust in the production process may be insufficient. When the number of carbon atoms exceeds 24, the handling of the compound becomes difficult.

In the quaternary ammonium compound shown by formula(2), m is 1 to 10, as described above, and this corresponds to the mole number of ethylene oxide attached. Preferably, m is 1 to 7. When m is 0, the effect of reducing paper dust cannot be obtained. When m exceeds 10, the effect of improving the softness is hardly obtained.

Examples of the alkyl group having 1 to 3 carbon atoms of $R^4$ in formula(2) include a methyl group, an ethyl group, a propyl group and an isopropyl group. Preferable examples thereof include a methyl group and an ethyl group. $X^-$ is an anion, and examples thereof include a fluorine ion, a chlorine ion, a bromine ion, an iodine ion, a methyl sulfate ion, and an ethyl sulfate ion. Preferable examples include a chlorine ion and a methyl sulfate ion;

In the quaternary ammonium salt shown by formula(3) of the ammonium compound (b), specifically, $R^5CO$ can be acyl derived from a carboxylic acid having 10 to 24 carbon atoms. Examples of such a carboxylic acid include a fatty acid such as capric acid, lauric acid, linderic acid, myristic acid, myristoleic acid, palmitic acid, palmitoleic acid, stearic acid, isostearic acid, oleic acid, linoleic acid, linolenic acid, elaidic acid, arachic acid, eicosenoic acid, behenic acid, erucic acid, lignoceric acid, and selacholeic acid; and a mixed fatty acid derived from natural oils or fats such as coconut oil fatty acid, palm oil fatty acid, beef tallow fatty acid, lard fatty acid, soybean oil fatty acid, rape seed oil fatty acid, tall oil fatty acid, olive oil fatty acid, cocoa butter fatty acid, sesame oil fatty acid, corn oil fatty acid, sunflower oil fatty acid, cotton seed oil fatty acid, and hydrogenated substances thereof. Different $R^5CO$ groups may be present in one molecule, and two or more types of the quaternary ammonium salts shown by formula (3) can be employed.

When the number of carbon atoms of $R^5CO$ is less than 10, the effect of improving the softness may be insufficient, and the effect of suppressing occurrence of paper dust is poor. When the number of carbon atoms is more than 24, the handling becomes difficult.

Specific examples of $R^6$ and $R^7$ in formula(3) include an ethylene group, a propylene group and a butylene group. A preferable example is an ethylene group.

Specific examples of the alkyl groups having 1 to 3 carbon atoms of $R^8$ include a methyl group, an ethyl group, a propyl group and an isopropyl group. Preferable examples thereof include a methyl group and an ethyl group. Specific examples of $X^-$ include a fluorine ion, a chlorine ion, a bromine ion, an iodine ion, a methylsulfate ion, and an ethylsulfate ion. Preferable examples include a chlorine ion and a methylsulfate ion.

All of these ammonium compounds (b) can be produced by any known method.

The ammonium compound (b) can be contained at a ratio of 300 parts by weight or less, preferably 1 to 300 parts by weight, more preferably 1 to 200 parts by weight, per 100 parts by weight of the amide compound (a). This makes it easy to obtain the effect of reducing the occurrence of paper dust in the paper formation process or of the obtained paper.

(III) Polyacrylamide Compound

The paper additive composition of the present invention contains a polyacrylamide compound, if necessary, in addition to the amide compound. In this specification, this polyacrylamide compound may be referred to as "polyacrylamide compound (c)" or simply "compound (c)".

As this polyacrylamide compound, anionic polyacrylamide, cationic polyacrylamide, amphoteric polyacrylamide, which are commonly used as additives for producing paper, can be utilized. Examples of anionic polyacrylamide include a product obtained by copolymerizing acrylamide and an anionic monomer (e.g., acrylic acid, methacrylic acid, and the like), and a partially hydrolyzed product of polyacrylamide. Examples of cationic polyacrylamide include a Mannich modified product or a Hofmann degradation product of polyacrylamide and a product obtained by copolymerizing acrylamide and a cationic monomer (e.g., dimethylaminoethyl methacrylate, diallyldimethylammonium chloride, diallyldiethylammonium chloride, methacryloyloxyethyl trimethylammonium methyl sulfate, methacryloyloxyethyl trimethylammonium methyl chloride, methacryloylamidopropyl trimethylammonium chloride, or the like). Examples of amphoteric polyacrylamide include a product obtained by copolymerizing acrylamide, an anionic monomer and a cationic monomer; and a Mannich modified product or a Hofmann degradation product of a product obtained by copolymerizing acrylamide and an anionic monomer as described above. Among these, cationic polyacrylamide and amphoteric polyacrylamide are preferable. The polyacrylamide compound can be used alone or in combination of two or more.

The polyacrylamide compound (c) can be contained at a ratio of 500 parts by weight or less, preferably 1 to 200 parts by weight, per 100 parts by weight of the amide compound (a).

(IV) Paper Additive Composition and Method for Producing Paper Using the Same

The paper additive composition of the present invention contains the amide compound (a), or contains at least one of the ammonium compound (b) and the polyacrylamide compound (c), in addition to the amide compound (a). This composition may further contain other additives that are described later, if necessary.

When the composition of the present invention contains the ammonium compound (b), particularly soft paper can be produced, and the occurrence of paper dust in the paper formation process and of the obtained paper can be reduced. When the composition of the present invention contains the polyacrylamide compound (c), particularly, the retention and the drainage in the paper formation process are good, and paper having a sufficient strength can be produced.

As other additives that can be contained in the composition of the present invention, the following compounds or materials can be employed: a paper strength additive, the examples of which include plant gum; a sizing agent, the examples of which include alkyl ketene dimmer, rhodine, and the like; filler, the examples of which include kaoline, talc, calcium carbonate, and the like; a drainage and retention aid, the examples of which include polyethyleneimine, cationic polymer, and the like; an internal additive, the examples of which include aluminum sulfate, sodium chloride, sodium aluminate, polyvinyl alcohol, latex, and the like; a pitch control agent; and a slime control agent.

A method for producing paper of the present invention is characterized by the use of the paper additive composition described above in the production of paper. More specifically, in the process of producing paper, it is preferable to add the composition in the range from 0.03 to 8 parts by weight, preferably 0.1 to 4 parts by weight, per 100 parts by weight of pulp. When the amount of the additive composition is too small, bulky and soft paper may not be obtained. With an excessive amount, an effect commensurate to the amount used cannot be obtained, which leads to an increase in the cost, and it is rather an economical disadvantage.

The composition of the present invention can be utilized in various processes in the production of paper. More specifically, the composition of the present invention can be added to a paper formation system in any stage in the paper formation process (this is an internal. addition method), or it is also possible to apply the composition onto the surface of a pulp sheet obtained by the paper formation process (this is an external addition method). For example, an internal addition method of adding the composition to a pulp slurry in a process of a mixing chest, a machine chest, a headbox or the like in the paper formation process can be employed. Alternatively, an external addition method including the process of size press, gate roll coater, spraying or the like in which the composition is applied onto the surface of a pulp sheet obtained by paper formation can be employed.

Each component of the additive composition can be mixed in a solvent, if necessary, and the mixture can be added to the paper formation system or applied to a sheet. Alternatively, each component can be added to a paper formation system or applied to a sheet separately.

In particular, the internal addition methods are preferably employed. For example, each component of the paper additive composition is added to a mixture containing pulp and water (e.g., pulp slurry) in a suitable process, and paper can be obtained by using the resultant mixture by conventional processes.

As the pulp (i.e., raw pulp), for example, chemical pulp (bleached or unbleached kraft pulp of softwood and hardwood, and the like), mechanical pulp (groundwood pulp, thermomechanical pulp, chemi-thermomechanical pulp, and the like), deinked pulp (pulp from waste paper of newspaper, magazines, etc.) can be used. They can be used alone or used in combination in any ratio.

In the paper formation process, when adding the additive for paper of the present invention, it is preferable that each of the components (the compound (a), and, if necessary, the ammonium compound (b), the polyacrylamide compound (c), and other additives) are previously mixed with a water-soluble alcohol that is monohydric, dihydric, or trihydric alcohol, because the viscosity of the additive is reduced so that the handling becomes easy. Examples of such a water-soluble alcohol include ethanol, 1-propanol, isopropanol, 1-butanol, t-butanol, 3-methoxy-3-methyl-butanol, propylene glycol, dipropylene glycol, 2-methyl-1,3-propanediol, 1,3-butanediol, 3-methyl-1,3-butanediol, glycerin and polyethylene glycol having a molecular weight of 150 to 600. Among these, 3-methoxy-3-methyl-butanol, propylene glycol, and polyethylene glycol having a molecular weight of 150 to 600 are preferable. These alcohols can be used in combination of two or more.

In the method for producing paper of the present invention, any types of machines such as a Fourdrinier paper machine, a twin-wire paper machine, and a Yankee paper machine, which are commonly used for paper formation, can be used.

According to the present invention, a paper additive composition that can provide bulky and soft paper and suppresses foam from occurring in the paper formation process can be provided. With this composition, bulky and soft paper having a sufficient strength can be obtained. Furthermore, paper dust in the paper formation process, or of the obtained paper hardly occurs. Such paper can be utilized as paper in various fields such as sanitary paper, paper for books, paper for newspaper, paper for printing and information, containerboards, and cardboards.

EXAMPLES

The present invention will be described more specifically by way of examples and comparative examples, but the present invention is not limited by these examples.

The contents (wt %) of fatty acids in of soybean oil fatty acid α, oleic acid α, erucic acid α, mixed fatty acid α, and mixed fatty acid β that are used for synthesis in the following examples, comparative examples and synthesis examples are as follows:

Soybean oil fatty acid α: palmitic acid (11.6%), stearic acid (4.2%), oleic acid (33.3%), linoleic acid (42.2%), linolenic acid (7.2%), and others (1.5%);

Oleic acid α: palmitic acid (2.0%), stearic acid (1.5%), palmitoleic acid (2.0%), oleic acid (91.0%), linoleic acid (2.0%), and others (1.5%);

Erucic acid α: stearic acid (0.4%), linoleic acid (0.4%), linolenic acid (2.7%), arachic acid (0.4%), behenic acid (1.0%), erucic acid (90.4%), lignoceric acid (2.0%), and others (2.7%);

Mixed fatty acid α: lauric acid (10.3%), myristic acid (7.5%), palmitic acid (10.2%), stearic acid (3.0%), oleic acid (26.4%), linoleic acid (34.2%), linolenic acid (5.8%) and others (2.6%); and Mixed fatty acid β: palmitic acid (9.8%), stearic acid (39.8%), oleic acid (45.6%), linoleic acid (3.2%), and others (1.6%).

<I> Preparation of Amide Compound (a)

Example 1.1

First, 283.0 g (1 mol) of soybean oil fatty acid α was placed in a 500 mL four-necked flask provided with a stirrer, a condenser, a thermometer and a nitrogen inlet tube (first stage). Then, the mixture was heated to increase the temperature to 90° C. in a nitrogen atmosphere while stirring. Then, 51.5 g (0.5 moles) of diethylenetriamine was added thereto, and a reaction was carried out at 180° C. for 2 hours while removing water to the outside of the system (second stage). Further, a dehydration reaction was carried out at 180° C. under a reduced pressure of 10 torr for 5 hours, so that a polyamide compound was obtained (third stage).

In the above reactions, the acid values of the reaction products in the second and the third stages were measured. The acid value of the reaction product in the second stage was 6.6, the total amine value was 92.1, and the tertiary amine value was 29.6 (the ratio of the tertiary amine value to the total amine value was 0.32). The amount of water distilled off was 17.8 g (the theoretical amount of water to be distilled off was 18.0 g, which is equivalent to the mole number of the fatty acid used). The acid value of the polyamine-polyamide compound (a-1) in the third stage was 3.2, the total amine value was 91.1, and the tertiary amine value was 82.1 (the ratio of the tertiary amine value to the total amine value was 0.90). The amount of water distilled off was 25.1 g.

Next, 60 g of the obtained compound (a-1), acetic acid in an amount of 5.9 g, which is the molar amount corresponding to the total amine value of the compound (a-1), and 534.1 g of ion exchanged water were placed in a 1 L beaker, and dispersed by stirring, so that a paper additive dispersion A (concentration: 10 wt %) shown in Table 1 was obtained in an amount of 600 g.

Table 1 shows the names and the molar ratio of the polyamine and the carboxylic acid used for synthesis and the acid values in the first, the second, and the third stages of the reaction product obtained from the polyamine and the carboxylic acid (the acid value in the first state is a theoretical value calculated from that of the raw materials). Table 1 further shows the total amine value, the tertiary amine value and the ratio of the tertiary amine value/the total amine value of the obtained compound (a), and the type of the salt of the compound (a). Table 1 also shows these values of Examples 1.2 to 1.17 and Comparative Examples 1.1 to 1.9 described later.

Example 1.2

A paper additive dispersion B was obtained by performing the same operation as in Example 1.1 except that no acetic acid was added and the amount of ion exchanged water was 540 g.

Examples 1.3 to 1.9

Paper additive dispersions C to I were obtained by performing the same operation as in Example 1.1, using the compounds shown in Table 1 in the ratios shown in Table 1. In Example 1.5, formic acid was used instead of acetic acid.

Examples 1.10 to 1.12

Paper additive dispersions J to L were obtained by performing synthesis in the same manner as in Example 1.1, using the compounds shown in Table 1 in the ratios shown in Table 1. In these examples, the dehydration reaction under a reduced pressure was carried out for one hour.

Examples 1.13 to 1.16

Paper additive dispersions M to P were obtained by performing the same operation as in Example 1.1, using the compounds shown in Table 1 in the ratios shown in Table 1.

Example 1.17

A paper additive dispersion Q was obtained by performing synthesis in the same manner as in Example 1.1, using the compound shown in Table 1 in the ratio shown in Table 1. In this example, the dehydration reaction under a reduced pressure was carried out for one hour.

Comparative Example 1.1

A paper additive dispersion R was obtained by performing the same operation as in Example 1.1, using the compound shown in Table 1 in the ratio shown in Table 1.

Comparative Example 1.2

A paper additive dispersion S was obtained by performing the same operation as in Example 1.1, using the compound shown in Table 1 in the ratio shown in Table 1, except that no acetic acid was added and the amount of ion exchanged water was 540 g.

Comparative Example 1.3

A paper additive dispersion T was obtained by performing the same operation as in Example 1.1, using the compound shown in Table 1 in the ratio shown in Table 1.

Comparative Examples 1.4 to 1.9

Paper additive dispersions U to Z were obtained by performing synthesis in the same manner as in Example 1.1, using the compounds shown in Table 1 in the ratios shown in Table 1. In these comparative examples, the dehydration reaction under a reduced pressure was not carried out.

TABLE 1

| | Polyamine | Carboxylic acid(s) | Molar ratio*1) | Compound (a) | Acid value First stage | Acid value Second stage | Acid value Third stage | Total amine value | Tertiary amine value | Tertiary amine value/Total amine value | Salt | Dispersion |
|---|---|---|---|---|---|---|---|---|---|---|---|---|
| Ex. 1.1 | Diethylenetriamine | Soybean oil fatty acid α | 2.0 | a-1 | 167.7 | 6.6 | 3.2 | 91.1 | 82.1 | 0.90 | Acetic acid | A |
| Ex. 1.2 | Diethylenetriamine | Soybean oil fatty acid α | 2.0 | a-1 | 167.7 | 6.6 | 3.2 | 91.1 | 82.1 | 0.90 | — | B |
| Ex. 1.3 | Diethylenetriamine | Soybean oil fatty acid α | 1.7 | a-2 | 163.2 | 3.8 | 1.8 | 127.6 | 78.1 | 0.61 | Acetic acid | C |
| Ex. 1.4 | Diethylenetriamine | Soybean oil fatty acid α | 2.4 | a-3 | 172.1 | 12.3 | 6.8 | 52.6 | 46.4 | 0.88 | Acetic acid | D |
| Ex. 1.5 | Triethylenetetramine | Oleic acid α | 2.0 | a-4 | 159.9 | 6.0 | 3.6 | 149.7 | 94.3 | 0.63 | Formic acid | E |
| Ex. 1.6 | Tetraethylenepentamine | Erucic acid α | 2.0 | a-5 | 128.7 | 5.3 | 2.7 | 213.3 | 140.8 | 0.66 | Acetic acid | F |
| Ex. 1.7 | Diethylenetriamine | Isostearic acid | 2.0 | a-6 | 173.0 | 6.5 | 3.2 | 93.6 | 87.0 | 0.93 | Acetic acid | G |
| Ex. 1.8 | Diethylenetriamine | Ricinolic acid | 2.0 | a-7 | 156.7 | 5.9 | 3.5 | 90.9 | 82.7 | 0.91 | Acetic acid | H |
| Ex. 1.9 | Diethylenetriamine | Soybean oil/ fatty acid α Stearic acid (5/5)*2) | 2.0 | a-8 | 169.9 | 6.9 | 3.1 | 83.2 | 79.1 | 0.95 | Acetic acid | I |
| Ex. 1.10 | Diethylenetriamine | Soybean oil fatty acid α | 2.0 | a-9 | 167.7 | 6.6 | 4.5 | 93.2 | 59.6 | 0.64 | Acetic acid | J |
| Ex. 1.11 | Diethylenetriamine | Isostearic acid | 2.0 | a-10 | 173.0 | 6.5 | 4.3 | 94.1 | 61.2 | 0.65 | Acetic acid | K |
| Ex. 1.12 | Diethylenetriamine | Ricinolic acid | 2.0 | a-11 | 156.7 | 5.9 | 4.3 | 92.3 | 59.1 | 0.64 | Acetic acid | L |
| Ex. 1.13 | Oleyl propylenediamine | Erucic acid α | 1.1 | a-12 | 89.6 | 4.4 | 2.9 | 83.7 | 55.2 | 0.65 | Acetic acid | M |
| Ex. 1.14 | Tallowalkyl propylenediamine | Oleic acid α | 1.0 | a-13 | 85.9 | 3.8 | 2.3 | 95.1 | 79.9 | 0.84 | Acetic acid | N |
| Ex. 1.15 | Diethylenetriamine | Stearic acid | 2.0 | a-14 | 172.2 | 6.8 | 3.5 | 88.5 | 78.6 | 0.89 | Acetic acid | O |
| Ex. 1.16 | Diethylenetriamine | Soybean oil/ fatty acid α Stearic acid (3/7)*3) | 2.0 | a-15 | 169.0 | 6.7 | 3.7 | 89.5 | 75.7 | 0.85 | Acetic acid | P |
| Ex. 1.17 | Diethylenetriamine | Stearic acid | 2.0 | a-16 | 172.2 | 6.8 | 4.6 | 90.9 | 59.1 | 0.65 | Acetic acid | Q |
| Com Ex. 1.1 | Diethylenetriamine | Octylic acid | 2.0 | a-17 | 301.7 | 23.6 | 18.8 | 179.7 | 152.7 | 0.85 | Acetic acid | R |
| Com Ex. 1.2 | Ethylenediamine | Soybean oil fatty acid α | 2.0 | a-18 | 179.2 | 6.5 | 3.4 | 8.6 | 5.4 | 0.63 | — | S |
| Com Ex. 1.3 | Diethylenetriamine | Soybean oil fatty acid α | 1.3 | a-19 | 154.8 | 2.1 | 1.2 | 147.8 | 77.4 | 0.52 | Acetic acid | T |
| Com Ex. 1.4 | Diethylenetriamine | Soybean oil fatty acid α | 2.0 | a-20 | 167.7 | 6.4 | — | 94.5 | 40.2 | 0.43 | Acetic acid | U |
| Com Ex. 1.5 | Diethylenetriamine | Isostearic acid | 2.0 | a-21 | 173.0 | 6.5 | — | 95.9 | 33.6 | 0.35 | Acetic acid | V |
| Com Ex. 1.6 | Diethylenetriamine | Ricinolic acid | 2.0 | a-22 | 156.7 | 5.9 | — | 93.1 | 38.2 | 0.41 | Acetic acid | W |
| Com Ex. 1.7 | Diethylenetriamine | Stearic acid | 2.0 | a-23 | 172.2 | 6.8 | — | 92.1 | 38.0 | 0.41 | Acetic acid | X |
| Com Ex. 1.8 | Oleyl propylenediamine | Hexanoic acid | 1.1 | a-24 | 131.9 | 10.5 | — | 124.7 | 4.1 | 0.04 | Acetic acid | Y |
| Com Ex. 1.9 | Tallowalkyl propylenediamine | Soybean oil fatty acid α | 0.3 | a-25 | 3.68 | 1.6 | — | 220.0 | 1.2 | 0.01 | Acetic acid | Z |

*1)Molar ratio of carboxylic acid to polyamine
*2), *3)Weight ratio of carboxylic acids <II> Preparation of Ammonium Compound (b)

Synthesis examples of ammonium compounds (b-2) to (b-7) that are quaternary ammonium salts shown by formula (3) and that are some of the ammonium compounds (b) used in the examples described later will be shown below.

Synthesis Example 1.1

First, 298.5 g (1.0 mole) of methyl oleate and 74.5 g (0.5 moles) of triethanol amine were placed in a four-necked flask provided with a stirrer, a condenser, a thermometer and a nitrogen inlet tube, and the mixture was heated to increase the temperature to 180° C. in a nitrogen atmosphere, and a reaction was carried out at 180° C. for 15 hours while removing methanol to the outside of the reaction system. Then, an ester compound having a hydroxyl group value of 84.1 and a total amine value of 80.3 was obtained. Then, 314.4 g (0.45 moles) of this ester compound and 330.0 g of ethanol were placed in a pressure-resistant reactor provided with a stirrer and a thermometer, and the gas phase was substituted with nitrogen at 60° C. Thereafter, 48.1 g (0.95 moles) of methyl chloride was added at 90° C. while stirring, and the resultant mixture was further stirred for 4 hours. Then, unreacted methyl chloride was removed under a reduced pressure, and thus a quaternary ammonium salt (ammonium compound (b-2)) having a total amine value of less than 0.1 was obtained. Table 2 shows names of groups corresponding to those in formula(3) of this compound.

Synthesis Example 1.2

A quaternary ammonium salt (b-3) shown in Table 2 was obtained by performing the same operation as in Synthesis Example 1.1, using methyl isostearate instead of methyl oleate.

Synthesis Example 1.3

First, 340.0 g (1.0 mole) of erucic acid a and 74.5 g (0.5 moles) of triethanolamine were placed in a four-necked flask provided with a stirrer, a condenser, a thermometer and a nitrogen inlet tube, and the mixture was heated to increase the temperature to 180° C. in a nitrogen atmosphere, and a reaction was carried out at 180° C. for 15 hours while removing water to the outside of the system. Then, an ester compound having a hydroxyl group value of 71.5 and a total amine value of 69.4 was obtained. Then, 323.3 g (0.4 moles) of this ester compound and 370.0 g of ethanol were placed in a reactor provided with a stirrer and a thermometer, and the gas phase was substituted with nitrogen at 60° C. Thereafter, 50.1 g (0.4 moles) of dimethyl sulfate was added at 70° C. while stirring and a reaction was carried out for 2 hours. As a result, a quaternary ammonium salt (ammonium compound (b-4)) having a total amine value of less than 0.1 was obtained.

Synthesis Examples 1.4 and 1.5

Quaternary ammonium salts (ammonium compounds (b-5) and (b-6)) as shown in Table 2 was obtained by performing the same operation as in Synthesis Example 1.3, using mixed fatty acid α or mixed fatty acid β instead of erucic acid α.

Comparative Synthesis Example 1.1

A quaternary ammonium salt (ammonium compound (b-7)) as shown in Table 2 was obtained by performing the same operation as in Synthesis Example 1.3, using octylic acid instead of erucic acid α.

TABLE 2

| | Ammonium compound | $R^3$ | $R^4$ | $R^5CO$— | $R^6$ | $R^7$ | m | $R^8$ | $X^-$ |
|---|---|---|---|---|---|---|---|---|---|
| Cation 20L-205 | b-1 | Octadecenyl | Methyl | — | — | — | 5 | — | Chlorine ion |
| Synthesis Ex. 1.1 | b-2 | — | — | Acyl derived from oleic acid α | Ethylene | Ethylene | — | Methyl | Chlorine ion |
| Synthesis Ex. 1.2 | b-3 | — | — | Acyl derived from isostearic acid | Ethylene | Ethylene | — | Methyll | Chlorine ion |
| Synthesis Ex. 1.3 | b-4 | — | — | Acyl derived from erucic acid α | Ethylene | Ethylene | — | Methyl | Methyl sulfate ion |
| Synthesis Ex. 1.4 | b-5 | — | — | Acyl derived from mixed fatty acid α | Ethylene | Ethylene | — | Methyl | Methyl sulfate ion |
| Synthesis Ex. 1.5 | b-6 | — | — | Acyl derived from mixed fatty acid β | Ethylene | Ethylene | — | Methyl | Methyl sulfate ion |
| Com. synthesis Ex. 1.1 | b-7 | — | — | Acyl derived from octylic acid | Ethylene | Ethylene | — | Methyl | Methyl sulfate ion |

<III> Preparation of Additive for Paper

Example 2.1

First, 244.4 g of a compound (a-1) as the compound (a), 23.8 g of acetic acid, 8.4 g of an ammonium compound (b-1) (Cation 20L-205 manufactured by NOF Corporation; a quaternary ammonium salt shown by formula(2); names of groups corresponding to those in formula(2) are shown in Table 2) as the ammonium compound (b), 60 g of propylene glycol, and 60 g of 3-methoxy-3-methyl-butanol were placed in a four-necked flask provided with a stirrer, a condenser, and a thermometer, and the mixture was stirred at 50° C. for 30 minutes, and thus an additive for paper X-1 was obtained. Table 3 shows the type or name of the compound (a) and the ammonium compound (b) and their weight ratio (a/b). Table 3 also shows the same for Examples 2.2 to 2.13 and Comparative Examples 2.1 to 2.5 described later.

Example 2.2

First, 314.6 g of a compound (a-1) as the compound (a), 21.9 g of acetic acid, 30.4 g of an ammonium compound (b-6) as the ammonium compound (b), and 20 g of polyethylene glycol (average molecular weight: 200) were placed in a four-necked flask provided with a stirrer, a condenser, and a thermometer, and the mixture was stirred at 50° C. for 30 minutes, and thus an additive for paper X-2 was obtained.

Examples 2.3 to 2.13

Additives for paper X-3 to X-13 were obtained by performing an operation according to Example 2.2, using the compounds (a) and the ammonium compounds (b) shown in Table 3 in the ratios shown in Table 3. In Example 2.7, the ammonium compound (b) was not used.

Comparative Example 2.1

An additive for paper X-14 was obtained by performing an operation according to Example 2.2, using only the ammonium compounds (b) shown in Table 3.

Comparative Examples 2.2 to 2.5

Additives for paper X-15 to X-18 were obtained by performing an operation according to Example 2.2, using the compounds (a) and the ammonium compounds (b) shown in Table 3 in the ratios shown in Table 3.

TABLE 3

| | Additive for paper | Compound (a) | Ammmonium Compound (b) | (a)/(b) |
|---|---|---|---|---|
| Example 2.1 | X-1 | a-1 | b-1 | 97/3 |
| Example 2.2 | X-2 | a-1 | b-6 | 92/8 |
| Example 2.3 | X-3 | a-7 | b-3 | 50/50 |
| Example 2.4 | X-4 | a-6 | b-4 | 75/25 |
| Example 2.5 | X-5 | a-8 | b-5 | 88/12 |
| Example 2.6 | X-6 | a-9 | b-2 | 30/70 |
| Example 2.7 | X-7 | a-1 | — | 100/0 |
| Example 2.8 | X-8 | a-1 | b-7 | 50/50 |
| Example 2.9 | X-9 | a-6 | di(tallowalkyl) dimethylammonium chloride | 30/70 |
| Example 2.10 | X-10 | a-9 | N,N-dipolyoxyethylene (5 mol) stearyl methyl ammonium chloride | 90/10 |
| Example 2.11 | X-11 | a-12 | b-3 | 70/30 |
| Example 2.12 | X-12 | a-13 | b-5 | 90/10 |
| Example 2.13 | X-13 | a-16 | b-4 | 78/22 |
| Com. Ex. 2.1 | X-14 | — | b-1 | 0/100 |
| Com. Ex. 2.2 | X-15 | a-17 | b-2 | 82/18 |
| Com. Ex. 2.3 | X-16 | a-19 | b-3 | 88/12 |
| Com. Ex. 2.4 | X-17 | a-24 | b-1 | 55/45 |
| Com. Ex. 2.5 | X-18 | a-25 | b-6 | 90/10 |

<IV> Evaluation of Additives for Paper

<IV-1>Evaluation of Additives for Paper Containing the Amide Compound (a) and Additives for Paper Containing the Amide Compound (a) and the Ammonium Compound (b)

Example 3.1

<1> Preparation of Paper and Evaluation of Bulkiness

First, 1 L of tap water, 50.0 g of LBKP (hardwood bleached pulp) were fed into a 2L disintegrator (a pulper manufactured by Kumagai Riken Co. Ltd.) for disintegration for 15 minutes, and thus LBKP pulp slurry was obtained. A part of this slurry was taken and placed in a 300 mL beaker and diluted with tap water, and thus 1.5 wt % LBKP pulp slurry was obtained in an amount of 80 g. The additive dispersion A shown in Table 1 was added in an amount of 0.12 g (1.0 part by weight of the additive with respect to 100 parts by weight of the pulp) to 80 g of this pulp slurry, and the resultant mixture was stirred at 250 rpm for 2 minutes with a turbine blade having a diameter of 4.5 cm in the 300 mL beaker. Thereafter, paper was formed such that the basis weight was about 60 g/m$^2$ by a sheet machine (TAPPI standard sheet machine manufactured by Yasuda Seiki Seisakusho Ltd.), pressed at 0.35 Mpa for 5 minutes with a pressing machine (manufactured by Yasuda Seiki Seisakusho Ltd.), and dried at 105° C. for 80 seconds with a drum dryer (manufactured by Yasuda Seiki Seisakusho Ltd.), and thus test paper was obtained.

The basis weight and the thickness of this test paper were measured, and the density was calculated. The basis weight was measured according to JIS P 8124, and the thickness was obtained by superimposing four of the obtained test papers and measuring the thickness of different 10 portions with a JIS type paper thickness measuring device (MEI-10 manufactured by Citizen Watch Co., Ltd.) and obtaining the average thereof. The percentage was calculated, taking the density of the test paper obtained in Comparative Example 3.8 (the additive dispersion was not used) described later as 100% (blank value), and evaluation was performed as follows.

The density is less than 95.0% of the blank value: the bulkiness is sufficient, and thus, the effect of the additive can be observed; shown by ○ in Tables.

The density is 95.0% or more of the blank value: the bulkiness is insufficient, and thus, the effect of the additive cannot be observed; shown by × in Tables.

Table 4 shows the results.

<2> Preparation of Paper and Evaluation of Softness

Paper was prepared in the same manner as in the above item <1>, except that the additive dispersion was not added, and paper having a basis weight of 20 g/m$^2$ was obtained. The additive dispersion A was uniformly sprayed manually onto the surface of this paper in an amount corresponding to 1.0 part by weight with respect to 100 parts by weight of the paper pulp in terms of dry weight. This was dried at 105° C. for 120 seconds with a drum drier and thus, test paper was obtained. Five of the test papers constituted one set, and a function evaluation of the softness was performed by touching the test paper with both hands that had been washed sufficiently with soap. Table 4 shows the results. The evaluation was performed according to the following five criteria, and the average of values obtained from 10 people was taken as the evaluation value.

| Evaluation | Softness |
|---|---|
| 1 | Hard |
| 2 | Substantially the same level as when no softening agent is used |
| 3 | Slightly soft |
| 4 | Soft |
| 5 | Very soft |

<3> Evaluation of Brightness of Paper

The brightness (WB) of test paper having a basis weight of 60 g/m$^2$ prepared by the same method as in the above item <1> was measured with a color meter (ZE-2000 manufactured by NIPPON DENSHOKU CO. LTD.). The brightness was evaluated according to the following criteria.

The brightness is 81.0 or more: the brightness is sufficient; shown by ○ in Table 4.

The brightness is less than 81.0: the brightness is not sufficient; shown by × in Table 4.

Table 4 shows the results.

<4> Evaluation of Peeling Property

Filter paper (5A manufactured by Advantech Toyo) and aluminum foil were cut into squares of 10 cm×9 cm. Separately, a commercially available liquid paste (O'GLUE GF5 manufactured by FUEKINORI KOGYO Co. Ltd.) and the additive dispersion A were mixed such that the weight ratio is 9/1, and the obtained mixture was applied uniformly onto the portion of 10 cm×6 cm of the filter paper in an amount of about 1 g, and then the aluminum foil was attached thereto with its back face as the attached face. This was sandwiched between chromium plated copper plates (circular, a diameter of 16 cm) and pressed at 0.35 MPa for 5 minutes, and then it was dried at 105° C. for one hour. This was pulled in the direction of 180° with respect to the attached face with a tensile strength tester (a tension/compression tester SV-201-0-SH manufactured by IMADA SEISAKUSHO CO. LTD.), and the. peel strength of the force with which the paper was peeled was measured. The peeling property was evaluated according to the following criteria.

The peel strength is less than 2.0 N: the peel strength is low and the effect regarding the peeling property is good; shown by ○ in Table 4.

The peel strength is 2.0 or more: the peel strength is high and the effect regarding the peeling property is insufficient; shown by × in Table 4.

Table 4 shows the results.

<5> Evaluation of Foaming Property

Foaming Property Test: Test Using a Floatater

First, 10.5 g of LBKP was added to 2089.5 g of tap water and disintegrated so that 0.5 wt % pulp slurry was prepared in an amount of 2100 g, which was kept at 25° C. in a bath. Then, 10% calcium carbonate and the paper additive dispersion A were added thereto such that the ratios were 50 parts by weight and 1.0 part by weight, respectively, with respect to 100 parts by weight of the pulp. Then, the mixture was stirred until it became uniform. This was stirred for 5 minutes in a floatater manufactured by Ota Kikai Seisakusho (i.e., a Kyoto University type floatater in which a baffle for removing foam was removed), and the height of the foam occurring in this case was measured. Table 4 shows the results. When the height of the foam is 70 mm or less, the foaming is low (shown by ○ in Tables). When the height of the foam exceeds 70 mm, the foaming is high (shown by × in Tables).

Example 3.2

The bulkiness, the softness, the brightness and the foaming property were evaluated in the same manner as in Example 3.1, except that the amount of the additive dispersion A added was changed such that the ratio of the additive became 0.5 parts by weight with respect to 100 parts by weight of the pulp. Regarding the peeling property, a test was performed under the same conditions as in Example 3.1. Table 4 shows the results.

Example 3.3

The bulkiness, the softness, the brightness and the foaming property were evaluated in the same manner as in Example 3.1, except that the amount of the additive dispersion A added was changed such that the ratio of the additive became 5.0 parts by weight with respect to 100 parts by weight of the pulp. Regarding the peeling property, a test was performed under the same conditions as in Example 3.1. Table 4 shows the results.

Examples 3.4 to 3.16

The same operation as in Example 3.1 was performed, except that the additive dispersion was changed to dispersions B to N of Table 1. Table 4 shows the results.

Examples 3.17 to 3.19

The same operation as in Example 3.1 was performed, except that the additive dispersion was changed to dispersions O to Q of Table 1. As a result, paper having sufficient bulkiness was obtained. Regarding the softness, the brightness, the peeling property, and the foaming property of this paper, the evaluations were slightly lower than those of Example 3.1.

Comparative Examples 3.1 to 3.7

The same operation as in Example 3.1 was performed, except that the additive dispersion was changed to dispersions R to X shown in Table 1. Table 4 shows the results.

Comparative Example 3.8

The same operation as in Example 3.1 was performed, except that no additive dispersion was added. Table 4 shows the results.

Comparative Examples 3.9 and 3.10

The same operation as in Example 3.1 was performed, except that the additive dispersion was changed to dispersions Y and Z shown in Table 1. Table 4 shows the results.

TABLE 4

| | | | Bulkiness | | | | Brightness | | Peeling property | | Foaming property | |
|---|---|---|---|---|---|---|---|---|---|---|---|---|
| | Dispersion | Additive (parts by weight)*1) | Density of paper (g/cm$^3$) | Density of paper*2 (%) | E-valu-ation | Softness | Bright-ness (WB) | Evaluation | Peel strength(N) | E-valu-ation | Hight of foam(mm) | Evaluation |
| Ex. 3.1 | A | 1.0 | 0.374 | 85.7 | ○ | 5 | 82.3 | ○ | 0.3 | ○ | 15 | ○ |
| Ex. 3.2 | A | 0.5 | 0.400 | 91.7 | ○ | 4 | 81.6 | ○ | 0.3 | ○ | 10 | ○ |
| Ex. 3.3 | A | 5.0 | 0.371 | 85.2 | ○ | 5 | 83.1 | ○ | 0.3 | ○ | 45 | ○ |
| Ex. 3.4 | B | 1.0 | 0.391 | 89.7 | ○ | 5 | 81.6 | ○ | 0.4 | ○ | 10 | ○ |
| Ex. 3.5 | C | 1.0 | 0.402 | 92.2 | ○ | 4 | 81.6 | ○ | 0.3 | ○ | 50 | ○ |
| Ex. 3.6 | D | 1.0 | 0.379 | 87.0 | ○ | 5 | 81.6 | ○ | 0.3 | ○ | 40 | ○ |
| Ex. 3.7 | E | 1.0 | 0.375 | 86.1 | ○ | 4 | 82.0 | ○ | 0.3 | ○ | 10 | ○ |
| Ex. 3.8 | F | 1.0 | 0.385 | 88.4 | ○ | 5 | 82.0 | ○ | 0.5 | ○ | 25 | ○ |
| Ex. 3.9 | G | 1.0 | 0.372 | 85.4 | ○ | 5 | 82.9 | ○ | 0.3 | ○ | 5 | ○ |
| Ex. 3.10 | H | 1.0 | 0.378 | 86.7 | ○ | 5 | 82.6 | ○ | 0.2 | ○ | 5 | ○ |
| Ex. 3.11 | I | 1.0 | 0.379 | 87.0 | ○ | 4 | 82.2 | ○ | 0.5 | ○ | 40 | ○ |
| Ex. 3.12 | J | 1.0 | 0.377 | 86.5 | ○ | 5 | 82.0 | ○ | 0.3 | ○ | 60 | ○ |
| Ex. 3.13 | K | 1.0 | 0.383 | 87.9 | ○ | 5 | 81.8 | ○ | 0.3 | ○ | 50 | ○ |
| Ex. 3.14 | L | 1.0 | 0.387 | 88.8 | ○ | 5 | 81.9 | ○ | 0.2 | ○ | 55 | ○ |
| Ex. 3.15 | M | 1.0 | 0.386 | 88.5 | ○ | 4 | 81.7 | ○ | 0.4 | ○ | 45 | ○ |
| Ex. 3.16 | N | 1.0 | 0.389 | 89.2 | ○ | 4 | 81.5 | ○ | 0.4 | ○ | 40 | ○ |
| Com. Ex. 3.1 | R | 1.0 | 0.425 | 97.4 | x | 2 | 79.3 | x | 4.5 | x | 45 | ○ |
| Com. Ex. 3.2 | S | 1.0 | 0.416 | 95.3 | x | 3 | 79.4 | x | 4.3 | x | 55 | ○ |
| Com. Ex. 3.3 | T | 1.0 | 0.424 | 97.2 | x | 3 | 79.6 | x | 3.8 | x | 95 | x |
| Com. Ex. 3.4 | U | 1.0 | 0.386 | 88.6 | ○ | 5 | 79.8 | x | 2.5 | x | 90 | x |
| Com. Ex. 3.5 | V | 1.0 | 0.392 | 89.9 | ○ | 5 | 76.7 | x | 2.6 | x | 95 | x |
| Com. Ex. 3.6 | W | 1.0 | 0.383 | 87.8 | ○ | 5 | 79.7 | x | 2.6 | x | 75 | x |
| Com. Ex. 3.7 | X | 1.0 | 0.404 | 92.6 | ○ | 3 | 79.2 | x | 2.8 | x | 155 | x |
| Com. Ex. 3.8 | — | — | 0.436 | 100.0 | x | 2 | 79.4 | x | 5.1 | x | 0 | ○ |
| Com. Ex. 3.9 | Y | 1.0 | 0.419 | 96.1 | x | 2 | 79.4 | x | 3.1 | x | 135 | x |
| Com. Ex. 3.10 | Z | 1.0 | 0.422 | 96.8 | x | 2 | 79.8 | x | 2.7 | x | 90 | x |

*1)Parts by weight per 100 parts by weight of pulp
*2)Density of paper (%) based on blank value Referring to the results of Examples 3.1 to 3.16 of Table 4, when a dispersion containing the paper additive composition of the present invention containing a specific amide compound is used, foams hardly occur in the paper formation process, and bulky and soft paper can be obtained. The brightness and the peeling property of the obtained paper are also good.

Example 4.1

Using the additive for paper X-1 obtained in Example 2.1 as the additive for paper, preparation of paper and evaluation of bulkiness in item <1>, preparation of paper and evaluation of softness in item <2>, and foaming property test in item <5> were performed according to Example 3.1. Furthermore, occurrence of paper dust shown in the following item <6> was also evaluated.

<6> Evaluation of Occurrence of Paper Dust

A black adhesive tape was attached onto the surface of test paper having a basis weight of 60 g/m$^2$ prepared according to the method described in item <1> of Example 3.1, and then detached. The area ratio of pulp fibers attached onto the black adhesive tape was measured with an image analysis device (SP 500F manufactured by OLYMPUS OPTICAL COMPANY LIMITED). The occurrence of paper dust was evaluated in the following criteria.

The area ratio of the attached pulp is less than 10%: little paper dust occurs; shown by ○ in Table.

The area ratio of the attached pulp is 10% or more: a lot of paper dust occurs; shown by × in Table.

Table 5 shows the results of evaluations mentioned above together.

Examples 4.2 to 4.12

The same operation as in Example 4.1 was performed, except that the paper additives X-2 to X-12 obtained in Examples 2.2 to 2.12 as the paper additive were used. Table 5 shows the results.

Example 4.13

The same operation as in Example 4.1 was performed, except that the paper additive X-13 obtained in Example 2.13 as the paper additive was used. As a result, paper having sufficient bulkiness was obtained. Regarding the softness, the occurrence of paper dust and the foaming property of this paper, the evaluations were slightly lower than those of Example 4.1.

Comparative Example 4.1

The same operation as in Example 4.1 was performed, except that no paper additive was used. Table 5 shows the results.

Comparative Examples 4.2 to 4.6

The same operation as in Example 4.1 was performed, except that the paper additives X-14 to X-18 obtained in Comparative Examples 2.1 to 2.5 as the paper additive were used. Table 5 shows the results.

TABLE 5

| | | | Bulkiness | | | | Occurrence of paper dust | | Foaming property | |
|---|---|---|---|---|---|---|---|---|---|---|
| | Paper additive composition | Amount of additive*1) | Density of paper (g/cm$^3$) | Density of paper*2) | Evaluation | Softness | Area ratio | E-valu-ation | Hight of foam (mm) | Evaluation |
| Example 4.1 | X-1 | 1.0 | 0.399 | 91.6% | ○ | 4 | 7.8% | ○ | 33 | ○ |
| Example 4.2 | X-2 | 0.5 | 0.402 | 92.2% | ○ | 5 | 7.5% | ○ | 14 | ○ |
| Example 4.3 | X-3 | 0.8 | 0.403 | 92.4% | ○ | 5 | 7.3% | ○ | 7 | ○ |
| Example 4.4 | X-4 | 0.6 | 0.400 | 91.8% | ○ | 5 | 7.2% | ○ | 35 | ○ |
| Example 4.5 | X-5 | 0.3 | 0.411 | 94.2% | ○ | 4 | 6.9% | ○ | 26 | ○ |
| Example 4.6 | X-6 | 2.2 | 0.409 | 93.7% | ○ | 5 | 8.4% | ○ | 40 | ○ |
| Example 4.7 | X-7 | 0.3 | 0.411 | 94.2% | ○ | 4 | 11.1% | x | 45 | ○ |
| Example 4.8 | X-8 | 1.2 | 0.403 | 92.5% | ○ | 4 | 10.8% | x | 38 | ○ |
| Example 4.9 | X-9 | 0.5 | 0.409 | 93.8% | ○ | 4 | 12.8% | x | 12 | ○ |
| Example 4.10 | X-10 | 0.8 | 0.402 | 92.3% | ○ | 4 | 15.1% | x | 42 | ○ |
| Example 4.11 | X-11 | 1.2 | 0.399 | 91.5% | ○ | 4 | 9.2% | ○ | 55 | ○ |
| Example 4.12 | X-12 | 0.7 | 0.402 | 92.4% | ○ | 4 | 8.4% | ○ | 40 | ○ |
| Com. Ex. 4.1 | — | — | 0.436 | 100.0% | x | 2 | 10.3% | x | 5 | ○ |
| Com. Ex. 4.2 | X-14 | 0.8 | 0.429 | 98.5% | x | 3 | 14.6% | x | 122 | x |
| Com. Ex. 4.3 | X-15 | 1.0 | 0.432 | 99.1% | x | 2 | 12.1% | x | 60 | ○ |
| Com. Ex. 4.4 | X-16 | 0.6 | 0.426 | 97.8% | x | 2 | 17.1% | x | 155 | x |
| Com. Ex. 4.5 | X-17 | 1.2 | 0.427 | 97.9% | x | 3 | 15.2% | x | 145 | x |
| Com. Ex. 4.6 | X-18 | 1.0 | 0.430 | 98.6% | x | 3 | 17.4% | x | 100 | x |

*1)Weight of additive (i.e., total weight of compound (a) and ammonium compound (b)) per 100 parts by weight of pulp)
*2)Density of paper (%) based on blank value As evident from the results of Table 5, when each of the paper additives of Examples 4.1 to 4.6, 4.11 and 4.12 of the present invention is used, foams hardly occur in the paper formation process, and bulky and soft paper can be obtained. Furthermore, occurrence of paper dust can be limited to a very small amount. In Examples 4.7 to 4.10, paper dust of the obtained paper occurs in a relatively large amount, but the bulkiness and the softness are sufficient.

On the other hand, in Comparative Example 4.1, no paper additive was added, so that bulky and soft paper could not be obtained and a large amount of paper dust occurred. In Comparative Example 4.2, the compound (a) was not used, so that bulky and soft paper could not be obtained and a large amount of paper dust and foams occurred. In Comparative Example 4.3, the number of carbon atoms of the fatty acid as a raw material of the compound (a) was smaller than the range defined in the present invention, so that bulky and soft paper could not be obtained and a large amount of paper dust occurred. In Comparative Examples 4.4 to 4.6, the molar ratio of the fatty acid as a raw material and the polyamine shown by formula(1) in the compound (a) was outside the range defined in the present invention, so that bulky and soft paper could not be obtained and a large amount of paper dust and foams occurred.

<IV-2> Evaluation of Additives Containing Amide Compound (a) and Polyacrylamide Compound (c)

Example 5.1

Using the additive for paper containing the amide compound (a) and the polyacrylamide compound (c) shown in Table 6 in the amounts (parts by weight with respect to 100 parts by weight of pulp; solid contents) shown in Table 6, preparation of paper and evaluation of bulkiness were performed according to Example 3.1. The bulkiness was evaluated, taking the density of the test paper obtained in Comparative Example 5.1 (no additive dispersion was used) described later as 100% (blank value).

Next, the obtained paper was subjected to humidity control for 17 hours in a constant humidity thermostatic chamber at a temperature of 23° C. and a humidity of 50%. The strength of this paper was evaluated by the method described in the following item <7>. Furthermore, the drainage and the retention of a system containing the above-mentioned additive were evaluated according to the method described in each of the following items <8> and <9>

<7> Evaluation of Strength of Paper

The above paper was cut into 15×120 mm to prepare a test piece. The tensile strength of this test piece was measured with a tension/compression tester (manufactured by IMADA SEISAKUSHO Co. Ltd.). The tensile index was calculated from the following equation, based on the obtained tensile strength, the width and the basis weight of the paper.

Tensile index (km)=(tensile strength (N)×1000)/(9.81×width (mm) of test piece×basis weight (g/m$^2$) of test piece)

Next, the percentage was calculated, taking the tensile index of the test piece obtained in Comparative Example 5.1 described later as 100% (blank value), and the strength of the paper was evaluated as follows.

The tensile index is 90.0% or more: the strength is sufficient; shown by ○ in Table.

The tensile index is less than 90.0%: the strength is insufficient; shown by × in Table.

<8> Evaluation of Drainage

LBKP was disintegrated with a disintegrator (manufactured by Kumagai Riken Co. Ltd.) to prepare 0.5 wt % pulp slurry. Then, 500 g of this pulp slurry were placed in a dynamic drainage jar having a diameter of 10.1 cm, height of 15.2 cm, and a filter provided at the drainage portion with a 50 mesh filter fabric. Calcium carbonate slurry was added in this slurry such that the ratio of the calcium carbonate was 10 parts by weight with respect to 100 parts by weight of the pulp. Furthermore, the amide compound (a-1) obtained in the above example and a cationic polyacrylamide compound α shown in Table 6 were added such that the ratios thereof were 0.3 parts by weight and 0.2 parts by weight, respectively, with respect to 100 parts by weight of the pulp. The obtained mixture was stirred at 1000 rpm for one minute, and then, the cock in the lower portion was opened for 30 seconds to collect filtered water, and the weight thereof was measured.

The amount of the filtered water is 450 g or more: the drainage is good; shown by ○ in Table.

The amount of the filtered water is less than 450 g: the drainage is insufficient; shown by × in Table.

<9> Evaluation of Retention

The filtered water collected in the above item <8> was filtered with a filter paper (A of type 5 defined in JIS P3801), the filter paper was dried at 105° C. for two hours, and the weight of the solid that remained on the filter paper was measured. This was taken as the solid weight in the filtered water.

The solid weight is less than 300 mg: the retention in the paper formation process is good; shown by ○ in Table.

The solid weight is 300 mg or more: the retention in the paper formation process is insufficient; shown by × in Table.

Table 6 shows the evaluation results of the bulkiness and the results of the items <7> to <9> above. Table 6 also shows the results of Examples 5.2 to 5.5 and Comparative Examples 5.1 to 5.4 described later.

Examples 5.2 to 5.5

The same operation as in Example 5.1 was performed, except that an additive containing the amide compound (a) and polyacrylamide compound (c) shown in Table 6 was used as the additive for paper.

Comparative Example 5.1

The same operation as in Example 5.1 was performed, except that the additive for paper was not used.

Comparative Example 5.2

The same operation as in Example 5.1 was performed, except that an additive containing the polyacrylamide compound (c) shown in Table 6 was used as the additive for paper.

Comparative Examples 5.3 and 5.4

The same operation as in Example 5.1 was performed, except that an additive containing the amide compound (a) and polyacrylamide compound (c) shown in Table 6 was used as the additive for paper.

TABLE 6

| | | | | | Bulkiness | | | Paper strength | | | Drainage | | Retention | |
|---|---|---|---|---|---|---|---|---|---|---|---|---|---|---|
| | Amide compound (a) | Amount*1 | Polyacrylamide compound (c)*2 | Amount*1 | Density of paper (g/cm$^3$) | Density of paper (%)*3 | Evaluation | Tensile index (km) | Tensile index (%)*4 | Evaluation | Amount of filtered water (ml) | Evaluation | Solid content (mg) | Evaluation |
| Example 5.1 | a-1 | 0.3 | Cationic polyacrylamide α | 0.2 | 0.403 | 92.4 | ○ | 4.20 | 95.2 | ○ | 459 | ○ | 265 | ○ |
| Example 5.2 | a-6 | 0.6 | Amphoteric polyacrylamide α | 0.5 | 0.396 | 90.8 | ○ | 4.08 | 92.5 | ○ | 468 | ○ | 262 | ○ |
| Example 5.3 | a-8 | 0.5 | Amphoteric polyacrylamide α | 0.3 | 0.406 | 93.1 | ○ | 4.25 | 96.4 | ○ | 464 | ○ | 264 | ○ |
| Example 5.4 | a-12 | 1.0 | Amphoteric polyacrylamide β | 0.7 | 0.389 | 89.2 | ○ | 4.04 | 91.6 | ○ | 470 | ○ | 256 | ○ |
| Example 5.5 | a-13 | 0.7 | Cationic polyacrylamide β | 0.4 | 0.401 | 92.0 | ○ | 4.13 | 93.7 | ○ | 455 | ○ | 262 | ○ |
| Com. Ex. 5.1 | — | — | — | — | 0.436 | 100.0 | x | 4.41 | 100.0 | ○ | 433 | x | 308 | x |
| Com. Ex. 5.2 | — | — | Cationic polyacrylamide α | 0.5 | 0.437 | 100.2 | x | 4.55 | 103.2 | ○ | 458 | ○ | 252 | ○ |
| Com. Ex. 5.3 | a-17 | 0.9 | Amphoteric polyacrylamide β | 0.4 | 0.427 | 97.9 | x | 4.21 | 95.5 | ○ | 455 | ○ | 266 | ○ |
| Com. Ex. 5.4 | a-25 | 1.2 | Cationic polyacrylamide β | 1.0 | 0.420 | 96.3 | x | 4.23 | 95.9 | ○ | 459 | ○ | 255 | ○ |

*1Parts by weight per 100 parts by weight of pulp

*2Cationic polyacrylamide α: Stargum KX-12 produced by Seiko Chemical Industries Co. Ltd. Cationic polyacrylamide β: HymorockDR-1500 produced by Hymo Co. Ltd. Amphoteric polyacrylamide α: Polystron 462 produced by Arakawa Chemical Industries, LTD. Amphoteric polyacrylamide β: Polyacron 380R produced by Seiko Chemical Industries Co. Ltd.

*3Density of paper (%) based on blank value

*4Tensile index (%) based on blank value

As evident from Table 6, when the additive containing the amide compound (a) and the polyacrylamide compound (c) is used, bulky paper having a sufficient strength can be obtained. The drainage and the retention during production were also excellent.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A method of producing soft paper comprising adding a paper additive composition to pulp, the paper additive composition comprising an amide compound (a) or a salt thereof for softening a paper, wherein the amide compound (a) is obtained by reacting a polyamine and a carboxylic acid, the polyamine is shown by formula (1):

$$R—(NH—R^1)n\text{-}NH_2 \quad (1)$$

wherein R is $H_2N—R^1$ or $R^2$, and each $R^1$ is independently an alkylene group having 1 to 4 carbon atoms, $R^2$ is an alkyl group or alkenyl group having 12 to 22 carbon atoms, and n is an integer of 1 to 3, the number of carbon atoms of the carboxylic acid is 10 to 24, the amide compound is obtained by reacting the carboxylic acid at a ratio of 0.5 to 4.3 moles per 1 mol of the polyamine, wherein the reaction is performed by a first reaction by reacting the polyamine and the carboxylic acid until the acid value of this reaction mixture reaches about 10% of the theoretical acid value of the initial mixture of the polyamine and the carboxylic acid and by a second reaction by allowing the reaction product of the first reaction to proceed until the acid value of this reaction mixture is further reduced to 75% or less of the acid value of the reaction product of the first reaction, and wherein the second reaction is performed under different conditions compared to that of the first reaction, and the ratio of a tertiary amine value to a total amine value of the amide compound (a) is 0.60 to 0.99.

2. The method of claim 1, wherein the carboxylic acid comprises a carboxylic acid having at least one of an unsaturated bond and a branched chain at a ratio of at least 40 wt %.

3. The method of claim 1, wherein the amide compound (a) or a salt thereof is added at a ratio of 0.03 to 8 parts by weight with respect to 100 parts by weight of pulp in a process of production of paper.

4. The method of claim 2, wherein the amide compound (a) or a salt thereof is added at a ratio of 0.03 to 8 parts by weight with respect to 100 parts by weight of pulp in a process of production of paper.

5. The method of claim 1, wherein the paper additive composition further comprises an ammonium compound (b), wherein the ammonium compound (b) is at least one selected from the group consisting of a quaternary ammonium salt shown by formula (2):

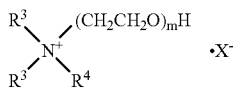

(2)

wherein each $R^3$ is independently a hydrocarbon group having 10 to 24 carbon atoms, $R^4$ is an alkyl group having 1 to 3 carbon atoms or a benzyl group, m is 1 to 10 and $X^-$ is an anion, and a quaternary ammonium salt shown by formula (3):

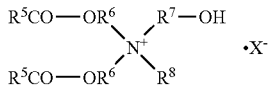

(3)

wherein each $R^5CO$ is independently an acyl group having 10 to 24 carbon atoms, each $R^6$ is independently an alkylene group having 2 to 4 carbon atoms, $R^7$ is an alkylene group having 2 to 4 carbon atoms, $R^8$ is an alkyl group having 1 to 3 carbon atoms or a benzyl group, and $X^-$ is an anion, and a weight ratio of the amide compound (a) or a salt thereof and the ammonium compound (b) is in the range of 100:1-300.

6. The method of claim 5, wherein the carboxylic acid comprises a carboxylic acid having at least one of an unsaturated bond and a branched chain at a ratio of at least 40 wt %.

7. The method of claim 5, wherein a mixture of the amide compound (a) or a salt thereof and the ammonium compound (b) is added at a ratio of 0.03 to 8 parts by weight with respect to 100 parts by weight of pulp in a process of production of paper.

8. The method of claim 6, wherein a mixture of the amide compound (a) or a salt thereof and the ammonium compound (b) is added at a ratio of 0.03 to 8 parts by weight with respect to 100 parts by weight of pulp in a process of production of paper.

9. The method of claim 1, wherein the paper additive composition further comprises a polyacrylamide compound (c), wherein a weight ratio of the amide compound (a) or a salt thereof and the polyacrylamide compound (c) is in the range of 100:1-200.

10. The method of claim 9, wherein the carboxylic acid comprises a carboxylic acid having at least one of an unsaturated bond and a branched chain at a ratio of at least 40 wt %.

11. The method of claim 9, wherein a mixture of the amide compound (a) or a salt thereof and the polyacrylamide compound (c) is added at a ratio of 0.03 to 8 parts by weight with respect to 100 parts by weight of pulp in a process of production of paper.

12. The method of claim 10, wherein a mixture of the amide compound (a) or a salt thereof and the polyacrylamide compound (c) is added at a ratio of 0.03 to 8 parts by weight with respect to 100 parts by weight of pulp in a process of production of paper.

13. The method of claim 5, wherein the paper additive composition further comprises a polyacrylamide compound (c), wherein a weight ratio of the amide compound (a) or a salt thereof and the polyacrylamide compound (c) is in the range of 100:1-200.

14. The method of claim 13, wherein the carboxylic acid comprises a carboxylic acid having at least one of an unsaturated bond and a branched chain at a ratio of at least 40 wt %.

15. The method of claim 13, wherein a mixture of the amide compound (a) or a salt thereof, the ammonium compound (b), and the polyacrylamide compound (c) is added at a ratio of 0.03 to 8 parts by weight with respect to 100 parts by weight of pulp in a process of production of paper.

16. The method of claim 14, wherein a mixture of the amide compound (a) or a salt thereof, the ammonium compound (b), and the polyacrylamide compound (c) is added at a ratio of 0.03 to 8 parts by weight with respect to 100 parts by weight of pulp in a process of production of paper.

* * * * *